US006863222B2

(12) United States Patent
Slifkin et al.

(10) Patent No.: US 6,863,222 B2
(45) Date of Patent: Mar. 8, 2005

(54) SYSTEM AND METHOD FOR FREIGHT REFRIGERATION POWER CONTROL

(75) Inventors: Timothy P. Slifkin, Morristown, NJ (US); Herbert Perten, Suffern, NY (US); Robert Schicke, Boonton, NJ (US); Richard F. Bladek, Sparta, NJ (US)

(73) Assignee: Statrak LLC, Morris Plains, NJ (US)

( * ) Notice: Subject to any disclaimer, the term of this patent is extended or adjusted under 35 U.S.C. 154(b) by 0 days.

(21) Appl. No.: 10/236,062

(22) Filed: Sep. 4, 2002

(65) Prior Publication Data

US 2004/0040317 A1 Mar. 4, 2004

(51) Int. Cl.[7] ..... B60H 1/32

(52) U.S. Cl. ..... 236/51; 62/239; 340/585

(58) Field of Search ..... 62/244, 239; 236/51; 340/585

(56) References Cited

U.S. PATENT DOCUMENTS

| | | | | | |
|---|---|---|---|---|---|
| 4,287,939 | A | * | 9/1981 | Pohl et al. | 236/51 X |
| 4,829,779 | A | * | 5/1989 | Munson et al. | 236/51 X |
| 5,499,512 | A | * | 3/1996 | Jurewicz et al. | 62/229 |
| 2003/0088323 | A1 | * | 5/2003 | Scalf et al. | 700/90 |

* cited by examiner

*Primary Examiner*—Harry B. Tanner
(74) *Attorney, Agent, or Firm*—Leo Stanger

(57) ABSTRACT

A mobile refrigerator unit is turned on and off remotely via wireless technology using a system with a secondary control switch, or a 'remote switch', which is part of a reefer trip remote control unit, and is operated via a wireless or combination communication link.

21 Claims, 4 Drawing Sheets

SYSTEM AND METHOD FOR FREIGHT REFRIGERATION POWER CONTROL

FIELD OF THE INVENTION

This invention relates to remote monitoring and control of mobile refrigeration units, and particularly for railroad cars, although the invention is applicable to refrigeration trucks and other mobile units.

BACKGROUND OF THE INVENTION

Microprocessors on mobile refrigeration units include a local power switch which, when turned off, completely disables a so-called reefer (mobile refrigeration) unit. This allows a man on a ground (i.e. on site) to power a unit off when not in service, or when working on a unit. However, this requires the presence of a person at or near the refrigeration unit.

An object of this invention is to provide additional remote control authority for mobile refrigeration and remote capability to turn on/off a mobile refrigeration unit.

SUMMARY OF EMBODIMENTS OF THE INVENTION

According to an embodiment of the invention, a system provides a secondary control switch, or a 'remote switch', which is part of a Reefer Trip Remote Control unit, and is operated via a wireless link. This capability permits a reefer unit to be turned on and off remotely via wireless technology.

The various features of novelty that characterize the invention are pointed out in the claims forming a part of this specification. Other objects and advantages of the invention will be evident from the following detailed description when read in light of the attached drawings.

DETAILED DESCRIPTION OF PREFERRED EMBODIMENTS

Figure 1:
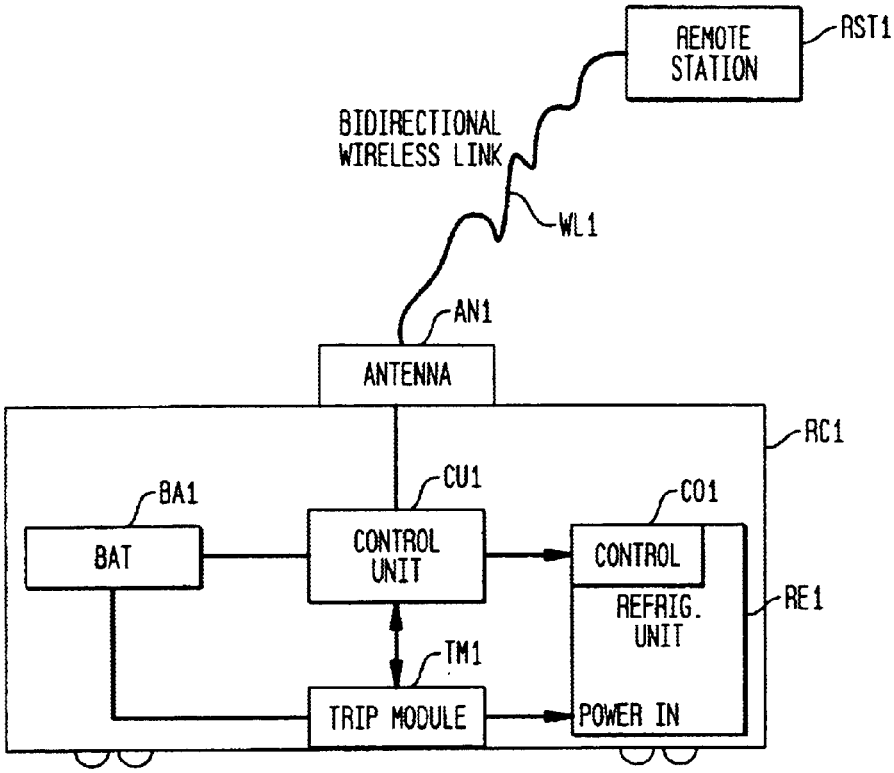
FIG. 1 is a block diagram of a system embodying the invention.

FIG. 1 illustrates a system for controlling a so-called (reefer unit) i.e. mobile refrigeration unit RE1 on a railroad car RC1. According to another embodiment the car RC1 is a motor truck or other mobile device carrying the refrigeration unit RE1. The refrigeration unit RE1 contains a local power switch which, when turned off, completely disables mobile refrigeration unit RE1, and when turned on permits operation of the unit. A control unit CU1 on the car RC1 monitors and controls the temperature and operation of the refrigeration unit RE1. An antenna AN1 connected to the control unit CU1 puts the control unit CU1 into communication with a remote station RST1 via a bi-directional wireless link WL1. According to an embodiment of the invention the wireless link is a station-to-station link. According to another embodiment of the invention, the wireless link WL1 is to another station and then via other wireless links or land lines, the Internet, or a combination of these, to the remote station RST1. According to yet another embodiment of the invention, the wireless link WL1 constitutes one or more satellites, alone or in combination with other links. In effect the wireless link WL1 represents a communication system generally. The remote station RST1 can remotely control the power to the refrigeration unit RE1 via the wireless link WL1, the antenna AN1, and the control unit CU1. The control unit CU1 and the trip module TM1 coact to allow a local maintenance person at the car RC1 to take ultimate authority to turn off the refrigeration unit RE1.

Figure 2:
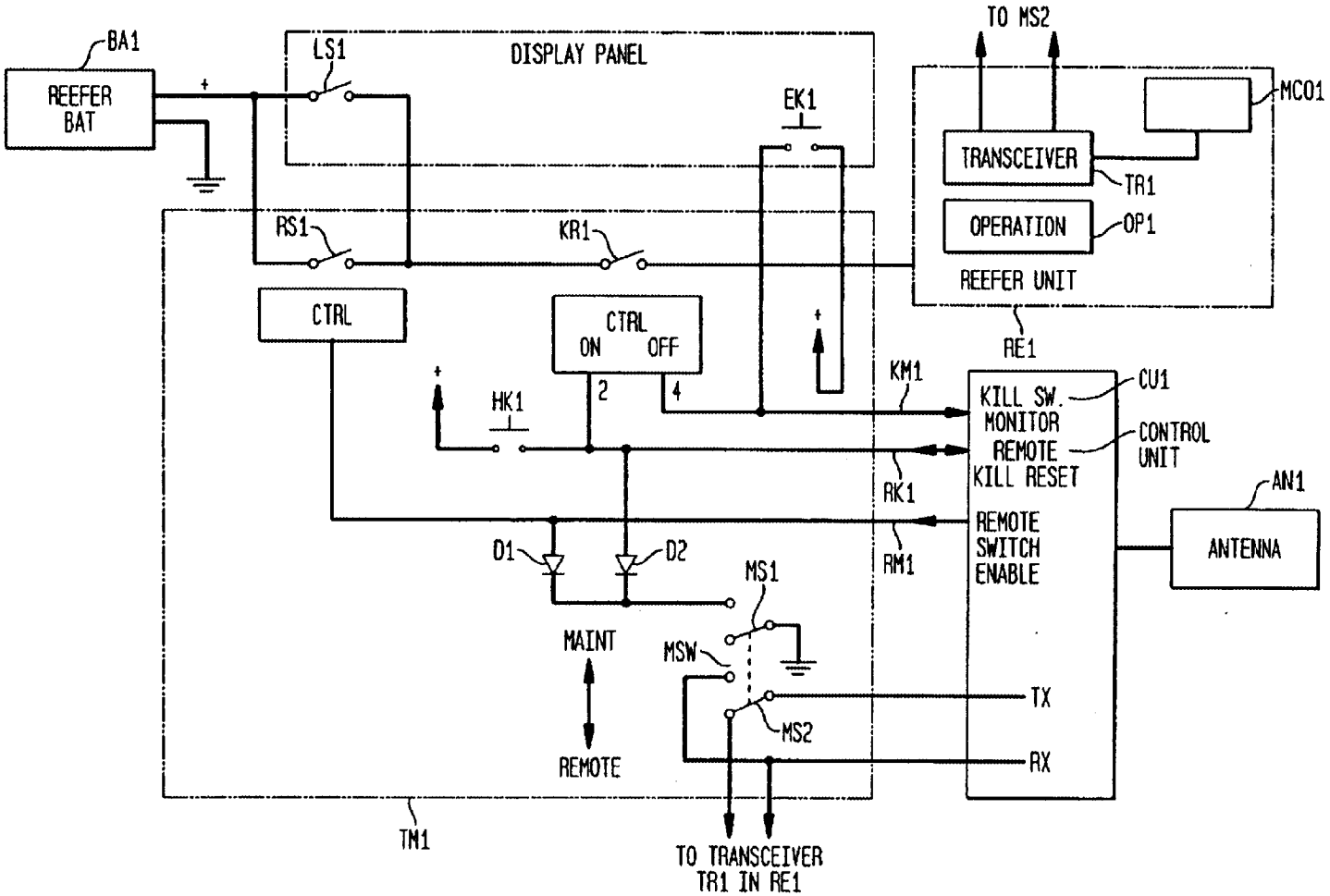
FIG. 2 is a block diagram of a reefer control arrangement embodying the invention.
Figure 3:
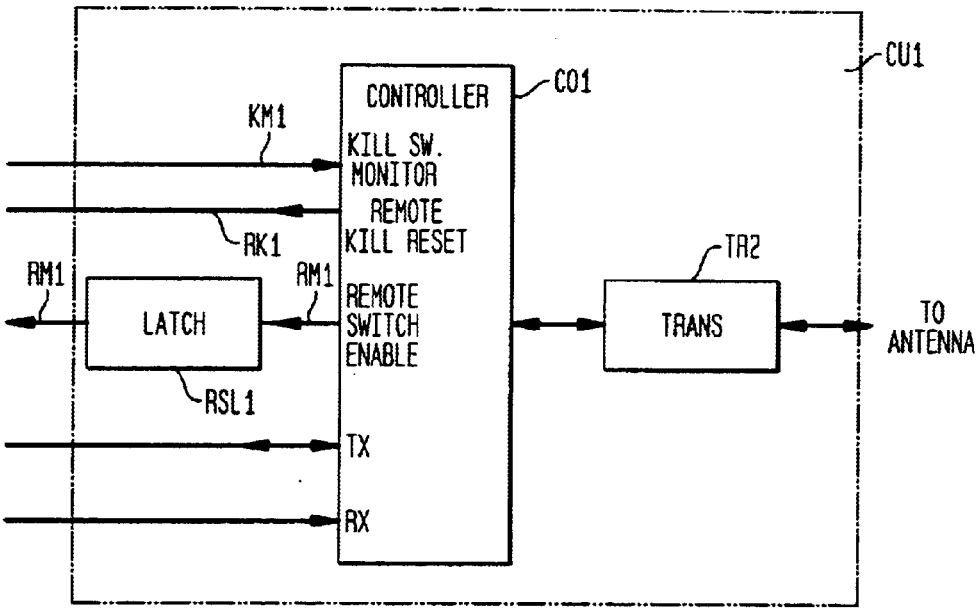
FIG. 3 is a block diagram of a control unit in FIG. 2

FIGS. 2 and 3 disclose an embodiment of the invention that include a secondary control switch, or a 'Remote Switch', which is part of the trip module TM1 embodying the invention, and is operated through the control unit CU1 via the wireless link WL1. As shown in FIG. 2, in usual operation, a local switch LS1 within the reefer unit RE1 remains normally closed after a workman or site operator on the car has closed it. Current then flows from the battery BA1 through a normally closed latching kill relay KR1 to the unit RE1. Typically, a site operator would turn the switch LS1 OFF prior to unloading the car; and turn it ON prior to loading the car.

Inadvertently leaving a local switch of a reefer unit RE1 in its OFF position, ordinarily would leave the unit without power and render the reefer unit RE1 inoperative. Typically, an operator would have to be dispatched to the car to operate the switch. The trip module TM provides an alternative path for power to the reefer unit RE1, through the remote switch RS1. This switch RS1 is controlled with the remote wireless link WL1, and can provide power to the reefer unit RE1 regardless of the state of the local switch LS1.

Normal operation of the reefer unit RE1 with the trip module TM1 requires local lowering (as shown in FIG. 2) of two ganged switches MS1 and MS2 of a maintenance switch MSW into a "REMOTE" position. These switches remain in the REMOTE position unless maintenance of the system requires opening them. In that case, a local technician or service personnel raise (as shown in FIG. 2) the maintenance switch MSW into the MAINTENANCE position. In the REMOTE position of the maintenance switch MSW, a latch RSL1 that responds to a signal on a remote switch enable line RM1 applies a positive or high signal to the control section of a remote switch RS1. This high signal closes the remote switch RS1. When a local technician places the maintenance switch MSW into the MAINTENANCE position, the cathode of diode D1 connects control section of a remote switch RS1 to ground through the switch MS1 of the maintenance switch MSW. This forces the control section of remote switch RS1 to go low regardless of the command from CU1. When the maintenance switch MSW is lowered into the REMOTE mode as shown in FIG. 2, the cathode of diode D1 is un-terminated, and control of the remote switch RS1 receives its latched high enable signal from the latch RSL1 in the control unit CU1.

The latching kill relay KR1 responds to two inputs identified as 2 (ON) and 4 (OFF). Normally, low or zero voltages appear at both inputs. A high or positive potential at input 4 latches the kill relay KR1 in the open position. A positive reset potential at the input 4 releases the latch and allows the relay to close.

In the event of an emergency, a site operator or any other person can push a clearly visible button on a momentary contact kill switch EK1. Operation of this button places a positive potential on input 4 of the latching kill relay KR1 and causes it to open. That removes power from the reefer unit RE1 regardless of the states of the local switch LS1 or remote switch RS1. The relay KR1 remains open until explicitly reset at the input 2, thereby rendering the RE1 unit without power and thereby inoperative.

The kill switch EK1 connects to a positive potential, which shows up on a kill switch monitor line KM1 and at a kill switch monitor in the control unit CU1. FIG. 3 illustrates details of the control unit CU1. Here, a controller CO1 in the control unit CU1 then automatically sends a message over the wireless link WL1 to alert remote maintenance personnel or technicians of the activation of kill switch EK1.

Two ways exist to reset the latching kill relay KR1 of FIG. 2. Both require that local service personnel have set the maintenance switch MSW in the REMOTE position. In one way of resetting the kill relay KR1, a trained technician on site uses a hidden reset button on a hidden reset switch HK1. This produces a positive potential at the input 2 of the latching kill relay KR1 via the switch MS1 and resets the relay KR1. In the other way, a trained technician at the remote station RST1 sends a signal over the wireless link WL1 that causes the controller CO1 to generate a positive potential on a remote kill reset line RK1. The positive voltage appears at the input 2 of the latching kill relay KR1 via the switch MS1. Access to the reset function by either method is limited to specifically trained technicians.

If switch MSW is in its MAINTENANCE position, the diode D2 ties the terminal 2 of the control section of switch KR1, thereby preventing any high signal from getting to the control of switch KR1, and keeping it open. Thus, power cannot be applied to the reefer unit RE1 inadvertently during maintenance.

The second pole MS2 of maintenance switch MSW enables and disables remote control of the reefer unit RE1. With the maintenance switch MSW in its REMOTE position, the pole MS2 connects serial control line TX to transceiver TR1, thereby allowing for remote control of reefer unit RE1. In the MAINTENANCE position, this connection is broken, and inhibits any remote control of RE1. A second connection through the second pole MS2 of maintenance switch MSW connects the line TX to line RX of the control unit CU1. This provides CU1 with an indication that the switch is in its MAINTENANCE position.

Control of Remote Switch RS1 by the control unit CU1 transpires through latch RSL1 shown in FIG. 3. The latch RSL1 remembers its condition if the controller CO1 reboots. In the event of an inadvertent reset, or reboot, of the controller CO1 in control unit CU1, latch RSL1 stays in the state it had before the reset. If its state was high before the interruption, latch relay RSL1 closes the switch RS1 and provides continuous power to reefer unit RE1. If its state was low before the interruption, latch relay RSL1 closes the switch RS1 and keeps reefer unit RE1 off.

The transceiver TR1 forms part of the reefer unit RE1 and senses the conditions of operation in the operation unit OP1 within the reefer unit. A microcontroller MCO1 in the reefer unit RE1 senses conditions, such as temperature, in the operation unit OP1 and other parts of the reefer unit. The transceiver TR1 transmits the conditions sensed to the controller CO1 in the control unit CU1. The controller CO1 then transmits these sensed conditions to the remote station RST1 via a transceiver TR2 and the antenna AN1. The controller CO1 also forms the kill switch monitor that monitors the condition of the kill switch EK1 via the kill switch monitor line KM1. It transmits this condition to the remote station RST1 via the transceiver TR2 and the antenna AN1. The controller CO1 also forms the remote kill reset that resets the latching kill relay KR1 via the remote kill reset line RK1. It receives a command to reset from a technician at the remote station RST1 via the transceiver TR2 and the antenna AN1. The controller CO1 also forms the remote switch enable that sets the latch RSL1 and latches the remote switch RS1 via the remote switch enable line RM1 in response to the remote station RST1 via the transceiver TR2 and antenna AN1.

The transceiver TR2 in the control unit CU1 transmits all signals to and from the controller CO1 from and to the antenna AN1.

The invention permits a reefer unit RE1 to be turned on and off remotely via wireless technology. In normal operation, the switching arrangement involving unit CU1 and trip module TM1 works so a remote operator can start the system in the event that a local technician has inadvertently left the 'Local Switch' in the 'OFF' position on the front panel. Also, the control unit CU1 operates so the remote operator can place the unit in service and take it out of service. The remote operator can access the unit when no ground personnel are there to gain utilization advantages. The remote operator can shut the unit RE1 down if the local switch in trip module TM1 was left on. To provide ultimate control, the circuitry is set to allow a technician working on the unit to guarantee that the unit will not be turned on via a remote command.

An embodiment includes a wireless link failure bypass should the remote system fail. A local service technician is able to bypass it so that the load can be saved and the shipment sent on its way.

There are two alternatives that exist in terms of who has control of the reefer unit; local man-on-the-ground personnel and a remote user. There are several variations of these topologies, but the basic operation is similar. The different topologies serve different operational modes. For example, rail car and intermodal customers have significantly different operational requirements than over-the-road truck operators.

In the local control mode, the reefer trip emote control unit does not operate. The remote station can send commands and elicit responses from a microprocessor, but cannot control power to it. The current 'Local Switch' on the front panel is the only control. If it is on, the micro is on. If it is off, the micro is off. This topology provides for minimum-impact monitoring and control of the load over the wireless link. The local man-on-the-ground has final authority.

During reefer trip remote control, a bypass relay 'Remote Switch' appears in parallel to the 'Local Switch'. This allows the remote link to turn on the microprocessor even if the main power switch is off. Further, a local 'Kill Switch' (electrically in series with the relay and main power switch) is mounted on the front panel. This is a momentary button that drives a latching relay. Once pressed, the relay latches in the OFF position, and the microprocessor unit becomes disabled (by removing power to the unit). The latching relay is then turned ON via a command over the remote link (with potentially yet an additional third-($3^{rd}$) level of password security). Further, any activation of the 'Kill Switch' causes an alarm to be sent to the Central Data Server. This discourages the use of the 'Kill Switch' to shut the unit down unless there is an emergency. In the event that the wireless link system is down, there is a hidden switch that will reset the Kill relay. According to an embodiment the Kill relay is disabled over the wireless link. This allows the reefer unit to be shut down remotely in the event that the 'Local Switch' was left on.

A 'Maintenance Switch', is mounted in a concealed area in the engine compartment. This switch allows a reliable local shut down of the entire unit by disabling the trip module TM1. It disables the 'Remote Switch' and disables the resetting of the 'Kill Switch'. It also disables the communication between the trip module TM1 unit and the reefer unit.

This offers operational flexibility, and overcomes the danger that a technician working on the unit may not know that an engine-start command has been sent over the link. It surmounts the problem that the 'Local Switch' on the unit's front panel (whether Thermo King or Carrier Transicold, for example) cannot be relied upon to accurately indicate the status of the microprocessor power (as it can be controlled remotely). Although the reefer units sound 30-second alarms prior to start-up, the maintenance switch helps when other conditions exist, such as when the alarm is damaged or ignored by the technician.

This arrangement allows the unit to be restarted locally or remotely during 'NORMAL' operation, yet, the local man-on-the-ground has the final authority during servicing or preventive maintenance schedules by using the 'Local Maintenance Switch' located in a concealed location in the engine compartment. In addition, the 'Kill Switch' is mounted on the front panel of the unit for emergency purposes during Normal operation to provide an immediate method of stopping the unit.

With this arrangement a technician can be certain that the reefer unit cannot be restarted remotely with the 'Maintenance Switch' in the 'Maintenance' position. If the 'Maintenance Switch' is left in the Maintenance position after servicing and the reefer unit is desired to restart, a person must be dispatched to the car to reset it. This solution allows a technician working on the reefer unit assurance that it cannot be turned on by a remote command or the position of the 'Master Switch' on the front panel. According to an embodiment of the invention, disconnecting the battery cable to the engine is also used as 'good maintenance practice' before any service is to take place on the reefer unit or trip module TM1.

The invention assures that local maintenance people/technicians can safely work on the units (i.e. 'Maintenance Switch', 'Kill Switch', additional inconveniences to enable a triggered kill switch, extensive training, 30 second alarm on the microprocessor prior to restarting).

The invention provides a way of shutting the system off for maintenance purposes. Should the wireless link system fail, a local operator is able to operate the equipment. The wireless technology of the embodiments permits utilization benefits, for example, the unit can be turned on and pre-tripped remotely in advance of picking up a load (reducing the need for local labor). It has the advantage of bypassing the 'Local Switch' should the local operator inadvertently leave it off. This thus furnishes a remote start-up/shutdown of the unit. From a freight monitoring and damage-prevention perspective, it permits turning the unit back on if it is inadvertently left off by a service tech after completing his work. This means that there is a way of bypassing the 'Local Switch' via a command over the wireless link.

The 'Maintenance Switch' and a 'Kill Switch' also serve safety purposes. The 'Maintenance Switch' completely disables the remote control system. The service technician/local man-on-the-ground has the final authority during servicing or preventive maintenance schedules by using this 'Maintenance Switch' located in a concealed location in the engine compartment. The 'Kill Switch' will immediately shut down the reefer unit no matter if the 'Local Switch' or the 'Remote Switch' or both are enabled. The 'Kill Switch' is a red pushbutton and is in a highly visible location.

The voltage polarities for actuating and de-actuating elements are examples only and according to an embodiment of the invention are replaced with opposite polarities or different levels. Moreover According to an embodiment of the invention the relays are replaced with semiconductor or other devices having the capabilities of handling the currents used.

The remote station includes computers. Control of the remote station RST1 rests in the hands of technicians who respond to signals from the antenna AN1. According to an embodiment of the invention, some of the responses in the remote station RST1 occur automatically. According to an embodiment of the invention the computers in the remote station RST1 also automatically record all events indicated by signals arriving at the remote station.

Figure 4:
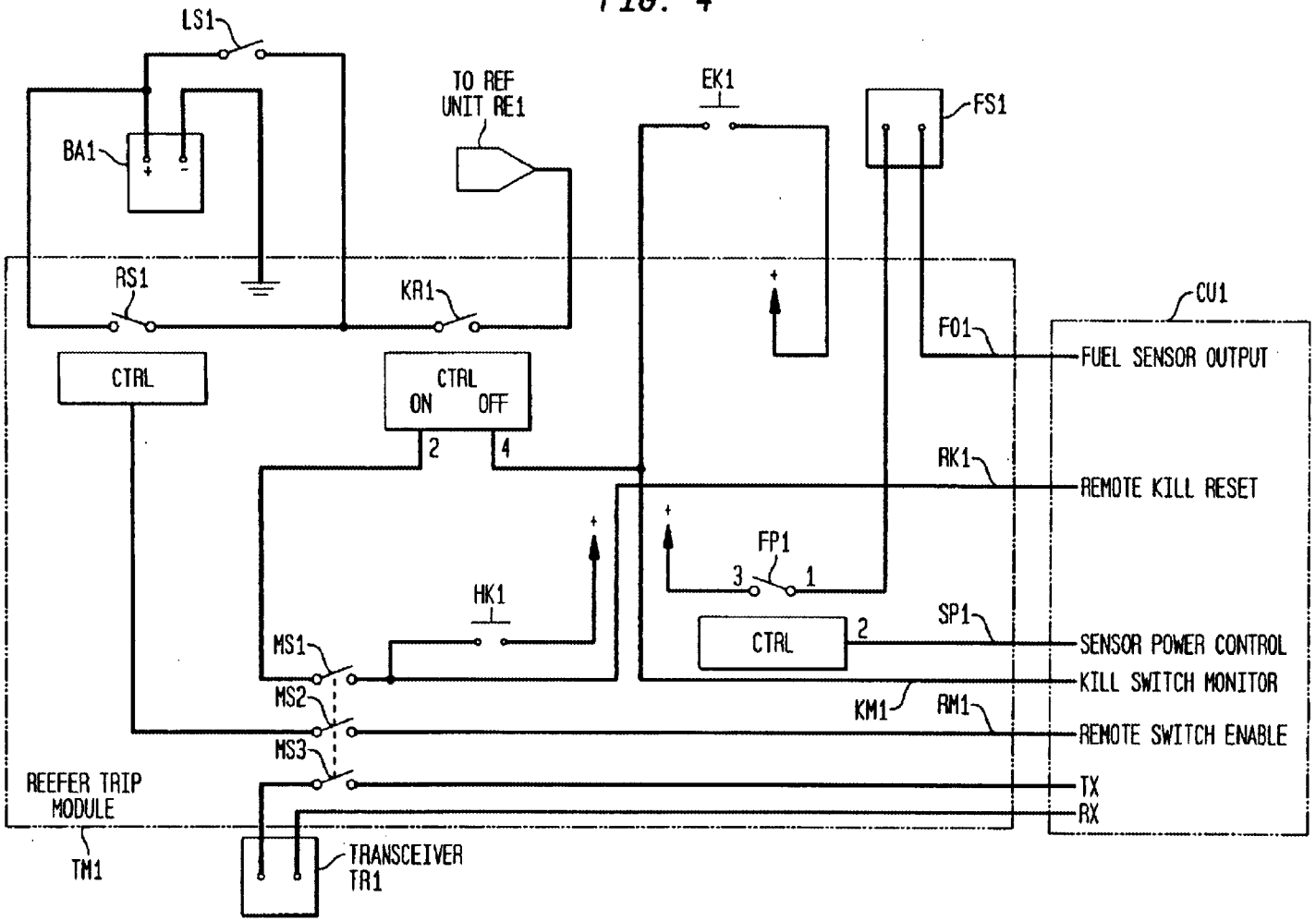
FIG. 4 is a block diagram of another reefer control arrangement embodying the invention.

Another embodiment of the invention appears in FIG. 4, wherein like reference characters represent like parts. In FIG. 4, operation of the reefer unit RE1 with the trip module TM1 requires local closing of three ganged switches MS1, MS2, and MS3 of a maintenance switch MSW. These switches remain closed unless maintenance of the system requires opening them. When in the normally closed position, the switch MS2 provides a path for a signal from the wireless link WL1 appearing on the remote switch enable line RM1 to reach the remote switch RS1. Here operation of reset the latching kill relay KR1 requires that three ganged switches MS1, MS2, and MS3 of the maintenance switch MSW assume the closed position in FIG. 4.

While embodiments of the invention have been described in detail, it will be evident to those skilled in the art that the invention may be embodied otherwise.

What is claimed is:

1. A control for a mobile refrigeration system, comprising:

an arrangement for locally turning the mobile refrigeration system on and off;

a reefer trip control unit having a remote switch remote from the mobile refrigeration system;

a communication link connecting the remote switch to the arrangement so the arrangement can be turned on and off via the communication link; and a local override to turn the mobile refrigeration off despite operation of the communication link and the arrangement;

said remote on-off arrangement providing an alternative path for power to the refrigeration component.

2. A refrigeration system, comprising:

a mobile unit having a refrigeration component and a refrigeration control;

a remote control;

a communication link linking the remote control and the refrigeration control;

said refrigeration control having a local on-off arrangement coupled to the refrigeration component to turn the refrigeration component on and off;

said refrigeration control having a remote on-off arrangement, responsive to said remote control via said communication link, and coupled to said local on-off arrangement, to turn the refrigeration component on and off; and said refrigeration control having a local override coupled to said local on-off arrangement, to turn the refrigeration component off;

said remote on-off arrangement providing an alternative path for power to the refrigeration component.

3. A system as in claim 2, wherein said refrigeration control has a local override coupled to said local on-off arrangement, to reset the refrigeration component on.

4. A system as in claim 2, wherein said refrigeration system is mounted in a vehicle.

5. A system as in claim 2, wherein said communication link is a wireless link or a land line or internet or via satellite or a combination of wireless land line satellite and/or internet.

6. A system as in claim 2, wherein said local override allows a local maintenance person to take ultimate authority to turn off the refrigeration component.

7. A system as in claim 2, wherein said local override includes a kill switch to turn off the refrigeration component.

8. A system as in claim 7, wherein said local override includes a reset switch to reset the refrigeration control.

9. A system as in claim 2, wherein said local override includes a selector assembly to set the refrigeration control into one of a maintenance mode responsive to said local on-off arrangement and a remote mode responsive to said remote on-off arrangement.

10. A system as in claim 7, wherein said local override further includes a selector assembly to set the refrigeration control into one of a maintenance mode responsive to said local on-off arrangement and a remote mode responsive to said remote on-off arrangement.

11. A system as in claim 8, wherein said local override includes a selector assembly to set the refrigeration control into one of a maintenance mode responsive to said local on-off arrangement and a remote mode responsive to said remote on-off arrangement.

12. A system as in claim 7, wherein said local override further includes a kill relay responsive to said kill switch to turn off the refrigeration component.

13. A system as in claim 8, wherein said local override further includes a kill relay responsive to said kill switch to turn off the refrigeration component, said kill relay having a position responsive to said reset switch to reset said refrigeration control.

14. A system as in claim 7, wherein said kill switch is manually operable.

15. A system as in claim 8, wherein said kill switch and said reset switch are manually operable.

16. A controller for a mobile refrigeration system, comprising:

a local on-off arrangement coupled to the refrigeration component to turn the refrigeration system on and off comprising;

a remote control;

a communication link;

a remote on-off arrangement, responsive to said remote control via said communication link, and coupled to said local on-off arrangement, to turn the refrigeration system on and off; and said refrigeration control having a local override coupled to said local on-off arrangement, to turn the refrigeration system off;

said remote on-off arrangement providing an alternative path for power to the refrigeration component.

17. A controller as in claim 16, wherein said local override includes a kill switch to turn off the refrigeration system.

18. A controller as in claim 17, wherein said local override includes a reset switch to reset the local on andarrangement.

19. A controller as in claim 16, wherein said local override includes a selector assembly to set one of a maintenance mode responsive to said local on-off arrangement and a remote mode responsive to said remote on-off arrangement.

20. A controller as in claim 19, wherein said local override further includes a selector assembly to set one of a maintenance mode responsive to said local on-off arrangement and a remote mode responsive to said remote on-off arrangement.

21. A controller as in claim 20, wherein said local override includes a selector assembly to set one of a maintenance mode responsive to said local on-off arrangement and a remote mode responsive to said remote on-off arrangement.

* * * * *